US007928644B1

(12) United States Patent
Tökés et al.

(10) Patent No.: US 7,928,644 B1
(45) Date of Patent: Apr. 19, 2011

(54) LOW PRESSURE DISCHARGE LAMP WITH ENVELOPE HAVING DOUBLE HELIX SHAPE AND SEALED ENDS

(75) Inventors: József Tökés, Budapest (HU); Sándor Lukács, Verõce (HU)

(73) Assignee: General Electric Company, Schenectady, NY (US)

( * ) Notice: Subject to any disclaimer, the term of this patent is extended or adjusted under 35 U.S.C. 154(b) by 2830 days.

(21) Appl. No.: 09/643,524

(22) Filed: Aug. 22, 2000

(51) Int. Cl.
*H01J 61/30* (2006.01)
*H01J 9/22* (2006.01)

(52) U.S. Cl. ..... 313/493; 313/609; 313/634; 313/611; 445/26

(58) Field of Classification Search ..... 313/493, 313/491, 634, 326, 490; 315/57, 58; 220/2.1 R, 220/2.3 R
See application file for complete search history.

(56) References Cited

U.S. PATENT DOCUMENTS

| | | | | |
|---|---|---|---|---|
| 4,133,077 | A | 1/1979 | Jasniewicz et al. | |
| 4,374,340 | A * | 2/1983 | Bouwknegt et al. | 313/493 |
| 4,648,850 | A * | 3/1987 | Lima et al. | 445/22 |
| 4,772,818 | A | 9/1988 | Koike et al. | |
| 5,055,738 | A * | 10/1991 | Yorifuji et al. | 313/490 |
| 5,675,215 | A * | 10/1997 | Watson et al. | 313/318.02 |
| 5,680,005 | A | 10/1997 | Soules et al. | |
| 5,705,883 | A * | 1/1998 | Soules et al. | 313/318.09 |
| 6,054,806 | A * | 4/2000 | Holzer | 220/2.1 R |
| 6,064,155 | A * | 5/2000 | Maya et al. | 313/318.01 |

FOREIGN PATENT DOCUMENTS

| | | | |
|---|---|---|---|
| DE | 212 843 | A | 8/1984 |
| DE | 41 33 077 | A | 4/1993 |
| DE | 197 53 259 | A1 | 10/1999 |
| EP | 0 231 957 | A | 8/1987 |
| EP | 0 735 570 | A2 | 10/1996 |
| EP | 1 182 688 | A1 | 2/2002 |

* cited by examiner

*Primary Examiner* — Sikha Roy
(74) *Attorney, Agent, or Firm* — Fay Sharpe LLP

(57) ABSTRACT

A low pressure discharge lamp with a double helix shape comprises a lamp base and an envelope connected to the lamp base. The envelope has a phosphor coating on an interior surface thereof, and contains a gas fill energizable to a discharge state by electrical voltage. The envelope includes discharge tube sections which are wound about a longitudinal axis and fitted into each other as a double-start thread. The discharge tube sections have first end portions and second end portions. The first end portions are closer to the lamp base and each have a gas-tight sealing and electrodes in the sealing for receiving the electric voltage. The second end portions are farther off the lamp base and each have a gas-tight sealing. These second end portions are bent inwards from a pitch of the helix and extend next to each other spaced apart by a clearance. A passage is formed between said second end portions. The passage is spaced apart by a distance from the sealing of each said second end portion.

9 Claims, 5 Drawing Sheets

LOW PRESSURE DISCHARGE LAMP WITH ENVELOPE HAVING DOUBLE HELIX SHAPE AND SEALED ENDS

FIELD OF THE INVENTION

This invention relates to a low pressure discharge lamp, and, more particularly, to a compact fluorescent lamp structure with a double helix shape.

BACKGROUND OF THE INVENTION

In low pressure discharge lamps, mercury dosed to the fill gas of the lamp is used for light generation. In order to produce visible light, phosphor coating is provided on the interior surface of the discharge envelope. Lamp manufacturers attempt to set the partial pressure of mercury vapor according to the highest radiation resonance line in order to accomplish the highest luminous output at the voltage and current density applied to the electrodes of the discharge envelope and to stabilize this partial pressure, as well. The adjustment and stabilization of mercury vapor partial pressure at a configuration of low pressure discharge lamps known so far is feasible by setting the temperature of a specially formed cold spot of the discharge envelope which is the coldest point of the lamp.

A helical configuration of low pressure discharge lamp is described in a patent issued in the late German Democratic Republic with No. 212 843. The discharge envelope of this lamp comprises a linear tube section and a helical tube section wound around the linear section with at least one loop. The linear section is connected to the helical section through a bridging at the upper end of the envelope further off the base of the lamp. This configuration of compact fluorescent lamp did not become a practical application because there would have been a need for two production lines for manufacturing the two different tube sections, which would have increased the expenses.

Formation of the cold spot is also difficult at this configuration since this can be accomplished only by means of lengthening the upper sealed part of the linear tube section in the vicinity of the bridging which results in poor esthetical appearance. The part of the helical section which connects to the linear section through the bridging has to be bent under a relatively sharp angle so that it can be connected to the linear tube section positioned in the central axis of the lamp. This sharp angle bending might cause peeling of the phosphor coating on the inner curve and cracked phosphor coating on the outer curve of the bent tube section which throw difficulties in the way of faultless manufacturing.

A double helix configuration of a low pressure discharge lamp is described in German Offenlegungsschrift DE 41 33 077 A1. The discharge envelope of the discharge lamp is helical in shape. At the top of the envelope, the ends of the tube sections are bent towards the central axis of the helix and the ends are melted together through a joining section of enlarged diameter. This enlarged diameter section is the cold spot of the lamp. When manufacturing this tube configuration, there is no need for two bending machines since the helical sections to be melted together are of identical shape. Nevertheless, bending under a relatively sharp angle makes faultless manufacturing also difficult due to the peeling and cracking of the phosphor coating.

U.S. Pat. No. 5,680,005 describes also a low pressure discharge lamp with a double helix configuration. The joining section of the two helical parts is formed of a slightly expanded linear tube that joins to the helically shaped tube parts through 180° bending. At this configuration of low pressure discharge lamp, the expanded linear tube can be considered as cold spot. However, the tube diameter in the 180° bending is reduced, thus the discharge arc warms up the walls of the tube, and the generated heat is conducted to the linear section making its operation as cold spot difficult. Due to the indefinite cold spot, the partial pressure of mercury vapor cannot be set to the optimum level and the luminous output of the discharge lamp does not attain the highest possible value.

Thus there is a particular need for a low pressure discharge lamp with a double helix shape which has a well-defined cold spot, a good esthetic appearance, and the manufacturing process of which is conducive to the faultless production.

SUMMARY OF THE INVENTION

In an exemplary embodiment of the present invention, a low pressure discharge lamp with a double helix shape comprises a lamp base and an envelope connected to the lamp base. The envelope has a phosphor coating on an interior surface thereof, and contains a gas fill energizable to a discharge state by electrical voltage. The envelope includes discharge tube sections which are wound about a longitudinal axis and fitted into each other as a double-start thread. The discharge tube sections have first end portions and second end portions. The first end portions are closer to the lamp base and each have a gas-tight sealing and electrodes in the sealing for receiving the electric voltage. The second end portions are farther off the lamp base and each have a gas-tight sealing. These second end portions are bent inwards from a pitch of the helix and extend next to each other spaced apart by a clearance. A passage is formed between said second end portions. The passage is spaced apart by a distance from the sealing of each said second end portion.

This construction has the advantage over the lamp of German Democratic Republic Patent No. 212 843 that its envelope can be manufactured less expensively using only one production line and has a good esthetic appearance. A further advantage is over the lamp described in DE 41 33 077 A1 that this construction when manufactured is less susceptible to phosphor peeling and cracking which results in a smaller scrap rate. A still further advantage is also over the lamp disclosed by U.S. Pat. No. 5,680,005, that this construction provides a more stable operation and higher luminous output due to well-defined cold spots.

DETAILED DESCRIPTION OF THE INVENTION

Figure 1:
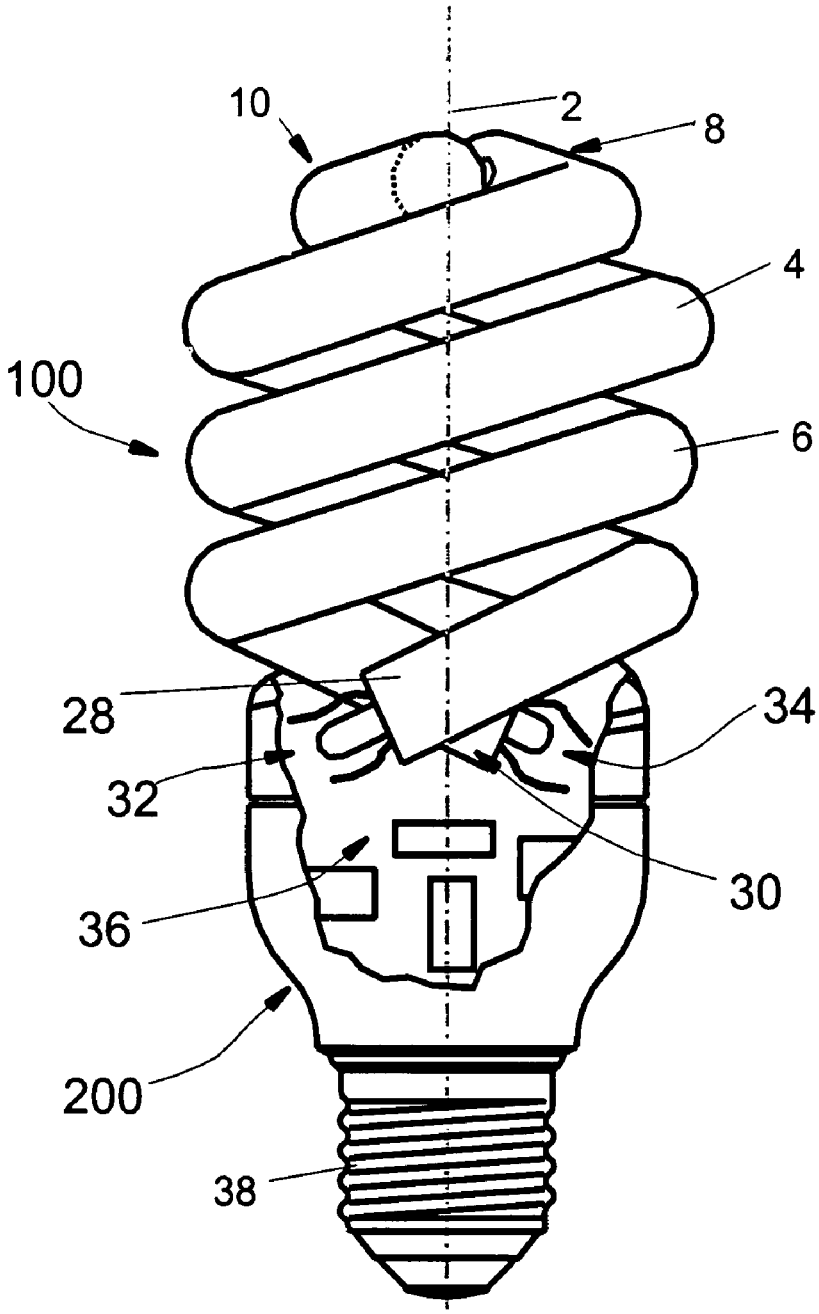
FIG. 1 is a partly broken out front view of an embodiment of a low pressure discharge lamp of double helix shape constructed with bridging.

FIG. 1 shows an embodiment of the low pressure discharge lamp having a double helix shape with an envelope 100 and mounted with a base 200 schematically. The mechanical and electrical connection of the low pressure discharge lamp to a suitable socket (not shown) is enabled by a threaded section 38 of the lamp base 200. The envelope 100 includes two discharge tube sections 4, 6 wound helically about a longitudinal axis 2. The pitch of the coiled discharge tube sections 4, 6 is such that it allows the discharge tube sections to be fitted into each other, i.e. there is sufficient space between the turns of one discharge tube section 4 or 6 to accept the turns of the other discharge tube section 6 or 4, respectively. The helically coiled discharge tube sections 4, 6 are fitted to each other as a double start thread about the longitudinal axis 2, i.e. the envelope 100 has a shape of double helix. The discharge tube sections 4, 6 have first end portions 28, 30 that are closer to the lamp base 200, and second end portions 8, 10 that are farther off the lamp base 200.

Figure 2:
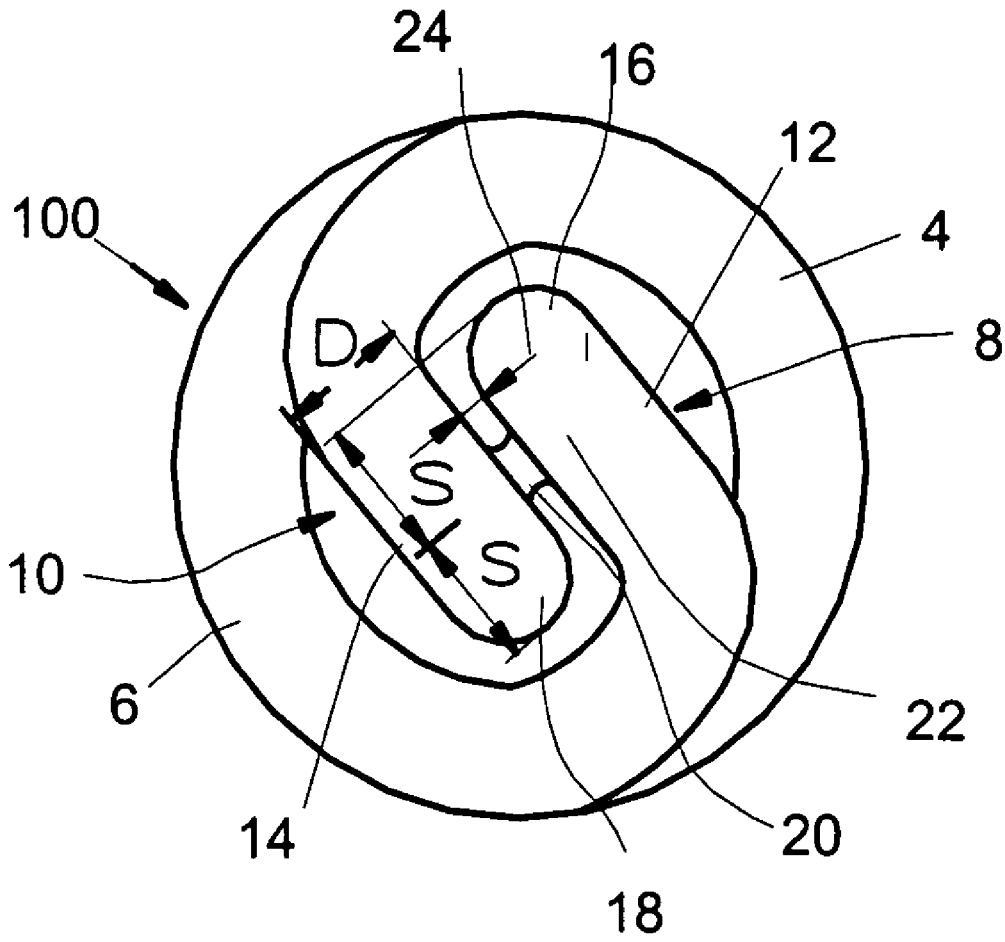
FIG. 2 is a top view of an envelope of the low pressure discharge lamp of FIG. 1.

As it is seen in a top view of the envelope 100 shown in FIG. 2, the second end portions 8, 10 of the discharge tube sections 4, 6 are bent inwards diametrically opposite to each other from the pitch of the helix along a curve which is smaller than the curve of the helically wound discharge tube sections 4, 6. The second end portions 8, 10 bent inwardly from the pitch of the helix or, in the embodiment shown in FIG. 2, their at least approximately straight tube sections 12, 14 extend next to and overlap each other. The second end portions 8, 10 or their straight tube sections 12, 14 are spaced apart from each other by a clearance 24.

The second end portions 8, 10 are sealed in a gas-tight manner, and a passage enabling a continuous discharge path is formed between the second end portions 8, 10 or, in the embodiment of FIG. 2, between the straight tube sections 12, 14 of the second end portions 8, 10. The passage is spaced apart from the sealing 16, 18 of each second end portion by a distance S.

Returning back to FIG. 1, the first end portions 28, 30 of the discharge tube sections 4, 6 being closer to the lamp base 200 are sealed in a gas-tight manner, and electrodes 32, 34 are set into these seals that connect to a ballast circuit 36. The way of connecting the electrodes 32, 34 to the ballast circuit 36 is not detailed here, it is known to experts skilled in the art.

The ballast circuit 36 located in the lamp base 200 generates an electrical voltage of appropriate parameters from the mains voltage which drives a gas fill in the envelope 100 in a state of discharge. The gas fill can be a noble gas, for example argon, to which mercury is dosed for the generation of visible light. Mercury radiates UV light primarily. In order to transform this UV radiation to visible light, the interior surface of the envelope 100 is provided with phosphor coating.

In the embodiment shown in FIGS. 1 and 2, the passage between the discharge tube sections 4, 6, that enables a continuous discharge arc path, is, a bridging 20. This bridging can be made by a method known from compact fluorescent lamp manufacturing. The discharge tube sections 4, 6 which can be made of soft glass are melted at a distance from their sealing with a thin flame. The melted spots are punctured with a blow and the snouts obtained are put together.

Due to the structure of the envelope 100 described above, two well-defined cold spots are formed in the vicinity of the sealing 16, 18 of the second end portions 8, 10 bent inwardly next to the longitudinal axis 2. Experience shows that it is advantageous with respect to forming well-defined cold spots if the distance S between an axis of the passage and a top of the sealing 16, 18 of the second end portions 8, 10 is 1-4 times the diameter D of the discharge tube.

The well-defined cold spot allows mercury vapor partial pressure to be set to a value corresponding to the highest intensity 253.4 nanometer resonance line of the mercury. An amount of the mercury vapor above its liquid phase giving rise to a higher partial pressure than the optimum one precipitates in the cold spot. On the other hand, when the mercury vapor partial pressure is lower than the optimum one, an appropriate amount of the liquid mercury condensed in the cold spot evaporates. Based on this, the luminous output of the low pressure discharge lamp can be set to the maximum value at a given power input.

The double cold spot construction according to the present invention enables the discharge operation of the lamp to be more stable compared to the operation of low pressure discharge lamps with double helix shape known so far. A 37° C. temperature of the cold spot desired at 24° C. ambient temperature is influenced not only by the positioning of the discharge path in the envelope 100 but the outer air flow carrying the heat generated by the discharge lamp. This air flow heats the cold spots on the top of the envelope 100 when the lamp is positioned vertically such as seen in FIG. 1 (base down position). In the event that the lamp has two cold spots, the enlarged cold spot surface is heated by the hot air flow less and the probability of heating both cold spots equally is small thus a well-defined cold spot will be formed by all means.

Compared to the low pressure discharge lamp with double helix shape described in German Offenlegungsschrift No. DE 41 33 077 A1, the second end portions 8, 10 of the discharge tube sections 4, 6 of the lamp according to the present invention are bent with a larger angle inwardly next to the longitudinal axis 2. The second end portions 8, 10 pass by the longitudinal axis at a distance. Due to the bending of the tube ends with a larger angle, the risk that the phosphor coating peels on the inner curve and cracks on the outer curve is reduced as a consequence of which the scrap rate of production will be decreased, too.

It is advantageous esthetically that the sealing 16, 18 of the second end portions 8, 10 of the discharge tube sections 4, 6 is at least approximately hemispherical in shape.

Figure 3:
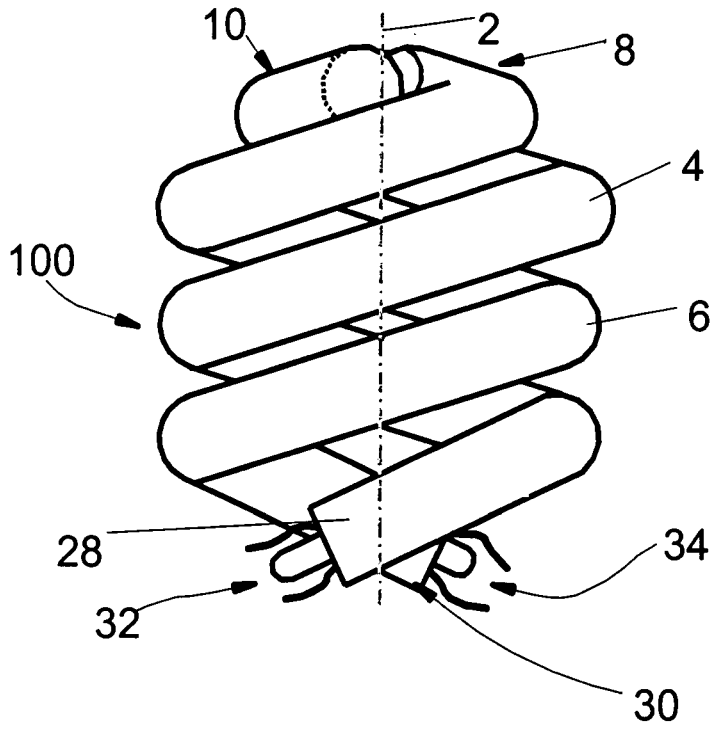
FIG. 3 is a front view of a further embodiment of the low pressure discharge lamp envelope with a double helix shape made by blow molding.
Figure 4:
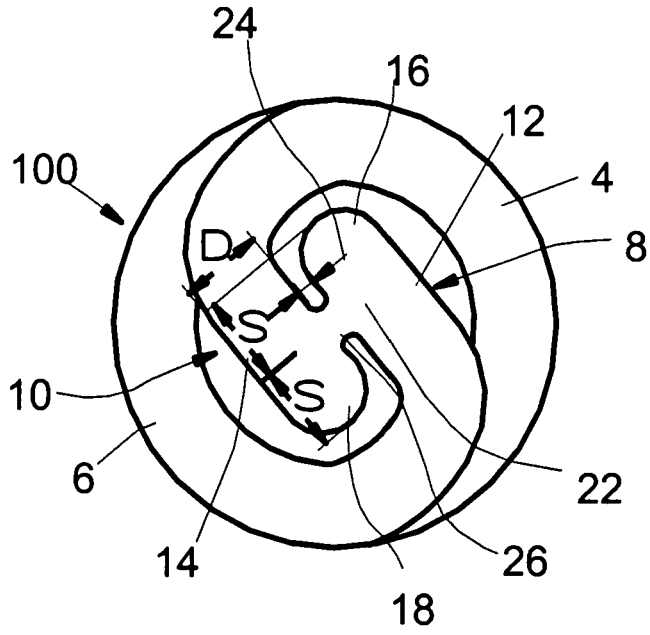
FIG. 4 is a top view of the low pressure discharge lamp envelope shown in FIG. 3.

Referring now to FIGS. 3 and 4, these figures show a further embodiment of the low pressure discharge lamp envelope with a double helix shape where the second end portions 8, 10 of the discharge tube sections 4, 6 bent inwardly next to the longitudinal axis 2 are formed with blow molding. The structure of the envelope 100 is similar to that shown in FIGS. 1 and 2. The identical envelope portions are denoted with the same reference signs, and their description is not repeated herein. However, the passage between the second end portions 8, 10 is formed by a duct 26 made with blow molding.

To blow molding, a straight soft glass tube may be used to start with, a middle section of which is afterwards heated to the melting point of the glass.

Subsequently, this middle section is placed into a form worked out with a shape and size corresponding to those of the second end portions 8, 10, their sealing 16, 18 and the duct 26 enabling the continuous discharge path. The second end portions 8, 10, the sealing 16, 18 and the duct 26 are then formed with an air blow. The whole glass body having been formed at the middle section thereof is then warmed up, and finally the tube legs projecting from the middle section are bent on a form with double-start thread.

Figure 5:
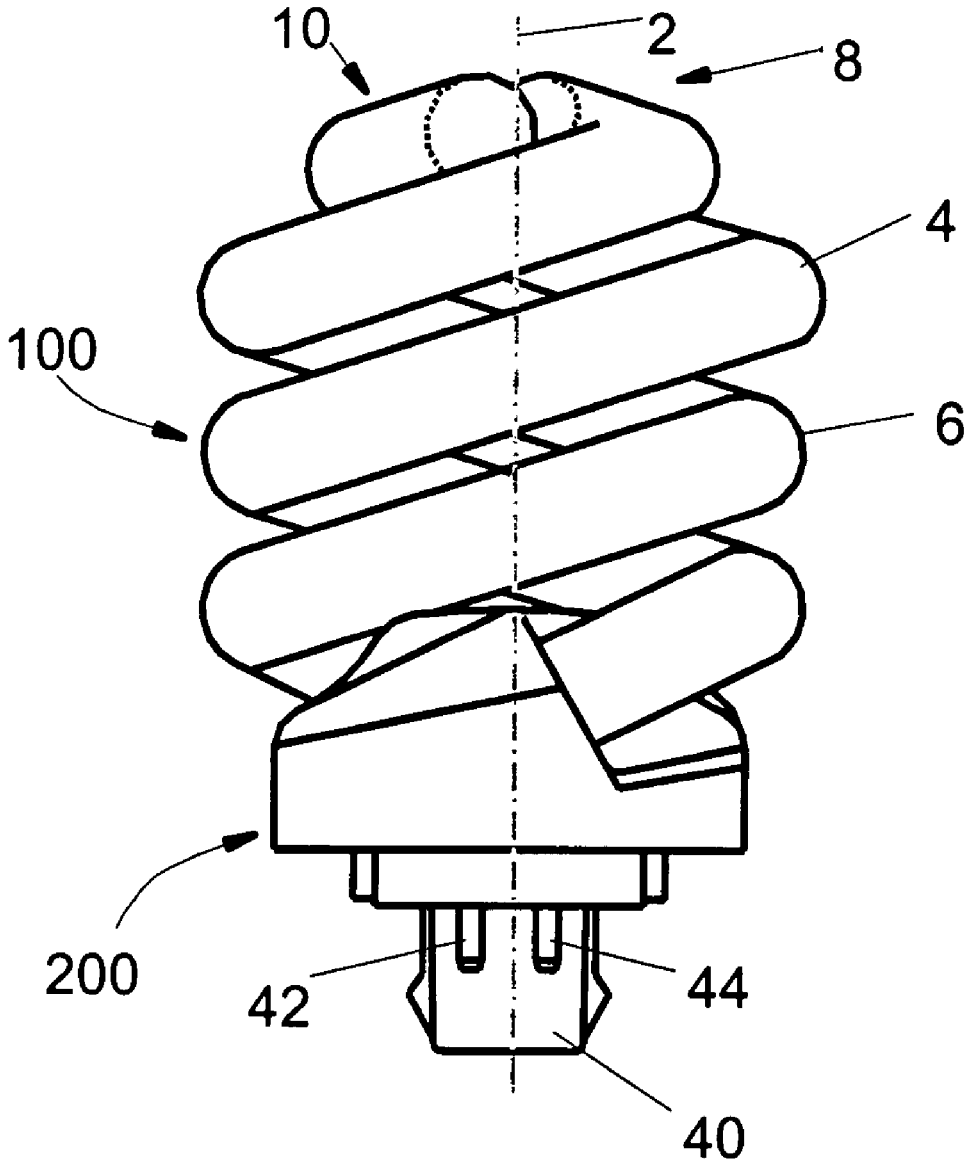
FIG. 5 is a front view of a still further embodiment of the low pressure discharge lamp mounted with the envelope shown in FIGS. 3 and 4.

FIG. 5 shows a plug-in embodiment of the low pressure discharge lamp with a double helix shape. The passage between the discharge tube sections 4, 6 coiled about the longitudinal axis 2 of the lamp is formed with blow molding but an envelope 100 the passage of which is formed with bridging is obviously also applicable. The ballast circuit is not mounted in the lamp at this embodiment but it forms a separate structural unit. A plug 40 projecting from the lamp base 200 serves for connecting the low pressure discharge lamp in a socket (not shown herein) mechanically, pins 42, 44 enable electrical connection to the ballast circuit (not shown herein) which forms a separate structural unit.

Figure 6:
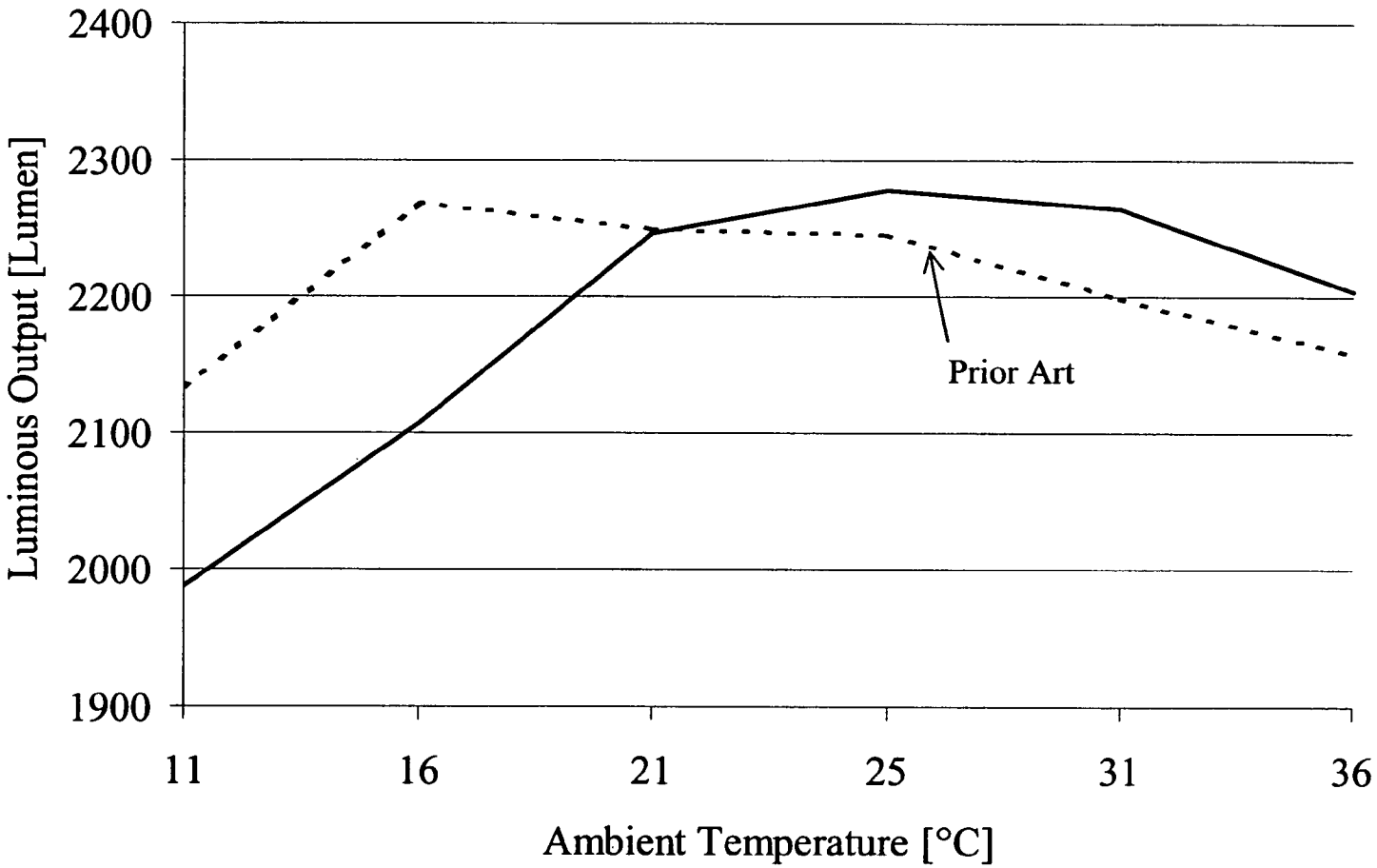
FIG. 6 is a diagram showing luminous output of a prior art lamp and a lamp constructed with bridging vs. ambient temperature.

Tests were conducted in order to prove that the double cold spot construction of a low pressure discharge lamp results in a more stable discharge operation and a higher luminous output than a low pressure discharge lamp known so far at ambient temperatures relevant to IEC standard requirements. FIG. 6, which is a diagram of the luminous output measured in lumens vs. the ambient temperature measured in ° C., illustrates the test results. A dotted line shows the luminous output of a prior art lamp constructed without the passage between the end portions of the discharge tube sections similarly to the lamp disclosed by U.S. Pat. No. 5,680,005. A continuous line shows the luminous output of a lamp constructed with the bridging 20. The rated power of both lamps was 32 W.

The test results clearly show that the lamp constructed with the bridging 20 provides higher luminous outputs at temperatures 25° C. and above which are specified by the IEC standard and correspond to the operating conditions of a lamp placed in a lamp armature.

The invention claimed is:

1. A low pressure discharge lamp having a double helix shape comprising:

a lamp base and an envelope connected to the lamp base, the envelope having a phosphor coating on an interior surface thereof and containing a gas fill energizable to a discharge state by electrical voltage, the envelope including discharge tube sections wound helically about a longitudinal axis and fitted into each other as a double-start thread, the discharge tube sections having first end portions and second end portions, the first end portions being closer to the lamp base and each having a gas-tight sealing and electrodes in the sealing for receiving the electric voltage, the second end portions being farther off the lamp base and each having a gas-tight sealing, the second end portions being bent inwardly from a pitch of the helix and extending next to each other spaced apart by a clearance, a passageway formed between said second end portions and spaced apart by a distance from the sealing of each said second end portion.

2. The discharge lamp of claim 1 in which said second end portions are bent inwards diametrically opposite to each other from the pitch of the helix.

3. The discharge lamp of claim 1 in which the passage is formed by bridging.

4. A method of forming a discharge lamp comprising:

providing an envelope with a phosphor coating on an interior surface thereof and a gas fill energizable to a discharge state by electrical voltage, the envelope including discharge tube sections wound helically about a longitudinal axis and fitted into each other as a double-start thread, the discharge tube sections having first end portions and second end portions, a lamp base and an envelope connected to the lamp base, the first end portions being closer to the lamp base and each having a gas-tight sealing and electrodes in the sealing for receiving the electric voltage, the second end portions being farther off the lamp base and each having a gas-tight sealing, said second end portions being bent inwardly from a pitch of the helix and extending next to each other spaced apart by a clearance; and forming a passage between said second end portions and spaced apart by a distance from the sealing of each said second end portion, the passage is being formed by a blow molding.

5. The discharge lamp of claim 1 in which the second end portions include at least approximately straight tube sections, and the passage is formed between the straight tube sections.

6. The discharge lamp of claim 1 in which the sealing of each second end portion is at least approximately hemispherical.

7. The discharge lamp of claim 1 in which the passage has an axis and the distance between the axis of the passage and a tip of the sealing of the second end portions is 1-4 times the discharge tube diameter.

8. The discharge lamp of claim 1 in which the lamp base is provided with a threaded portion suitable for connecting the lamp mechanically and electrically and a ballast circuit is located therein.

9. The discharge lamp of claim 1 in which the lamp base has a plug suitable for connecting the lamp mechanically and pins suitable for connecting the lamp electrically to a ballast circuit forming a unit separated from the lamp.

* * * * *